United States Patent [19]

McLamb

[11] 4,258,359

[45] Mar. 24, 1981

[54] PORTABLE PROTECTIVE DEVICE

[76] Inventor: Philip McLamb, 3301 Barnsley La., Raleigh, N.C. 27604

[21] Appl. No.: 960,540

[22] Filed: Nov. 14, 1978

Related U.S. Application Data

[63] Continuation-in-part of Ser. No. 845,094, Oct. 25, 1977, abandoned.

[51] Int. Cl.[3] ..... G08B 19/00

[52] U.S. Cl. ..... 340/546; 200/61.76; 200/61.93; 340/521; 340/628; 340/693

[58] Field of Search ..... 340/546, 521, 628, 584, 340/693; 200/61.93, 61.78, 61.76, 61.62

[56] References Cited

U.S. PATENT DOCUMENTS

| | | | |
|---|---|---|---|
| 2,670,466 | 2/1954 | Harper | 340/546 |
| 3,261,010 | 7/1966 | Kardel | 340/546 |
| 3,378,830 | 4/1968 | Patrick | 340/546 |
| 3,383,674 | 5/1968 | Soltau et al. | 340/521 |
| 3,567,882 | 3/1971 | Beck | 200/61.93 |
| 3,878,539 | 4/1975 | Gooding | 340/546 |
| 3,908,180 | 9/1975 | Braginsky | 340/521 |
| 3,968,483 | 7/1976 | Jolley | 340/628 |
| 4,019,112 | 4/1977 | Satoh | 340/636 |
| 4,059,832 | 11/1977 | Conklin | 340/546 |
| 4,151,520 | 4/1979 | Full | 340/546 |

*Primary Examiner*—Glen R. Swann, III

*Attorney, Agent, or Firm*—Pollock, Vande Sande & Priddy

[57] ABSTRACT

A portable, self-contained protection device includes a battery operated combustion product sensor and intrusion switch, providing energization to an audible warning device, all contained in a casing adapted to be mounted, for example, such as on a door. A spring biased retainer maintains the warning device in its mounted condition. Two forms of intrusion switch are disclosed, both of which have opened and closed conditions. When the warning device is mounted on the door, and the door is closed, the intrusion switch is maintained open, however when the door is opened, the intrusion switch closes, providing energy to the audible warning device. The combustion product sensor, likewise, provides energy to the audible warning device, upon sensing products of combustion. Auxiliary devices include an optical indicator issuing a light signal whenever the audible warning device is actuated. An external actuator may also be employed to actuate the warning device.

15 Claims, 11 Drawing Figures

FIG. 1
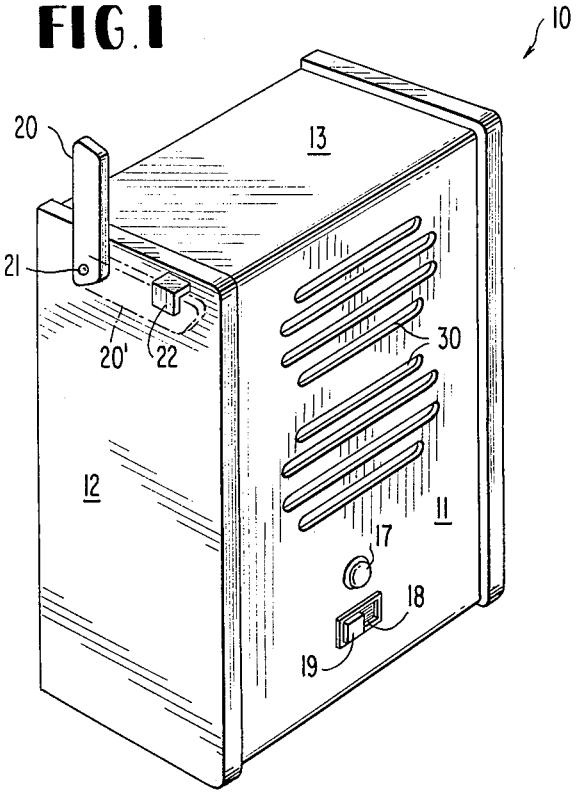
FIG. 2
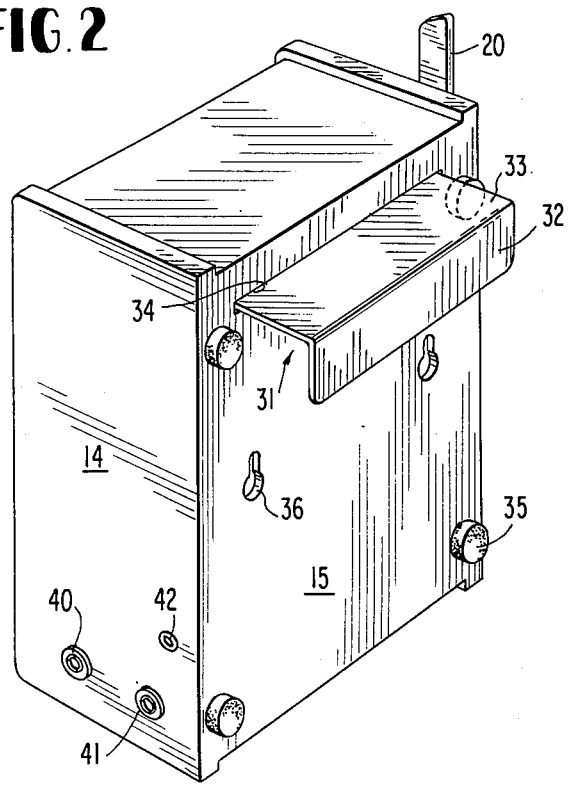
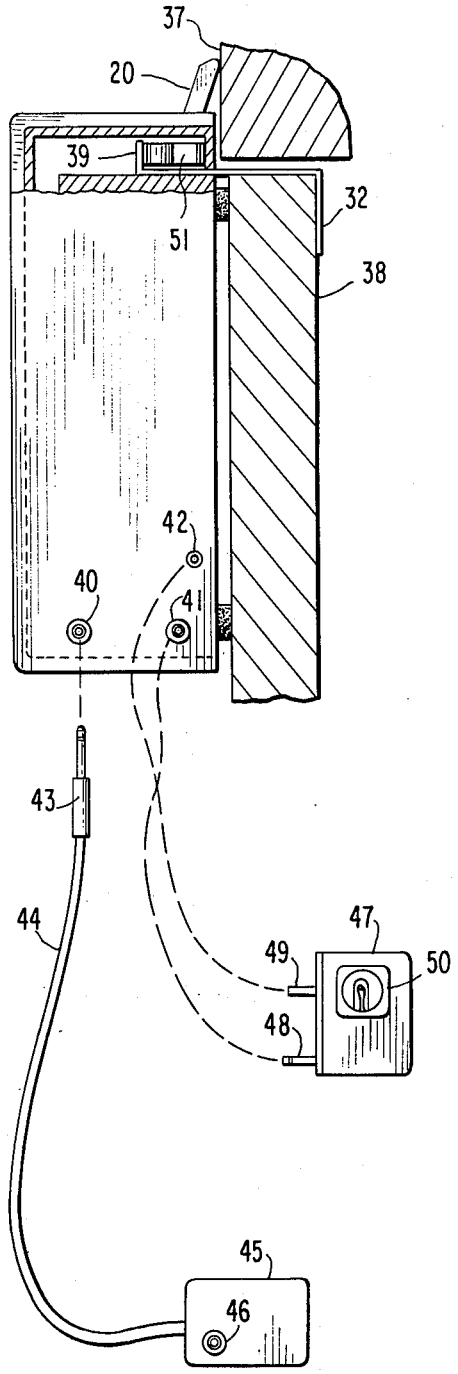
FIG. 3

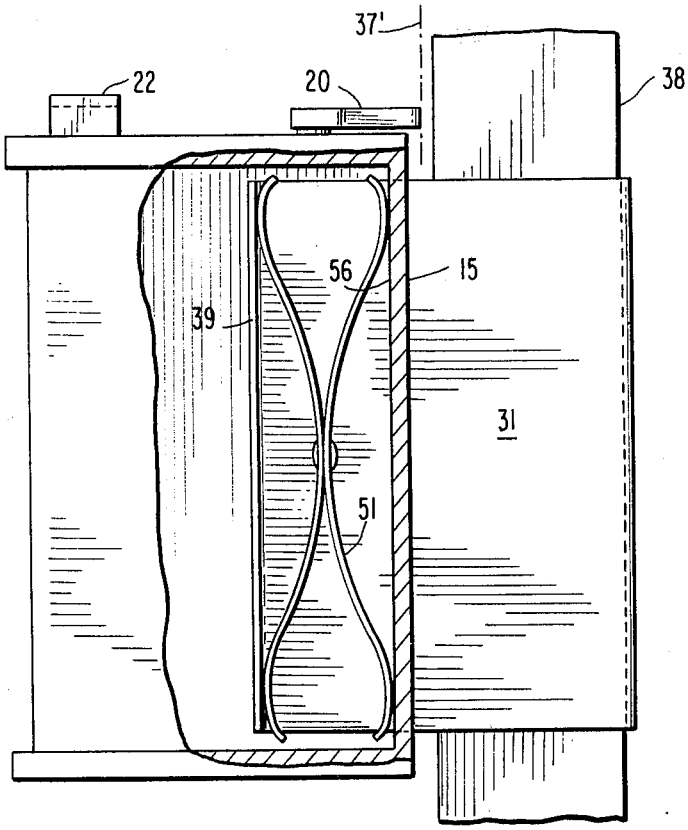
FIG. 4
FIG. 5
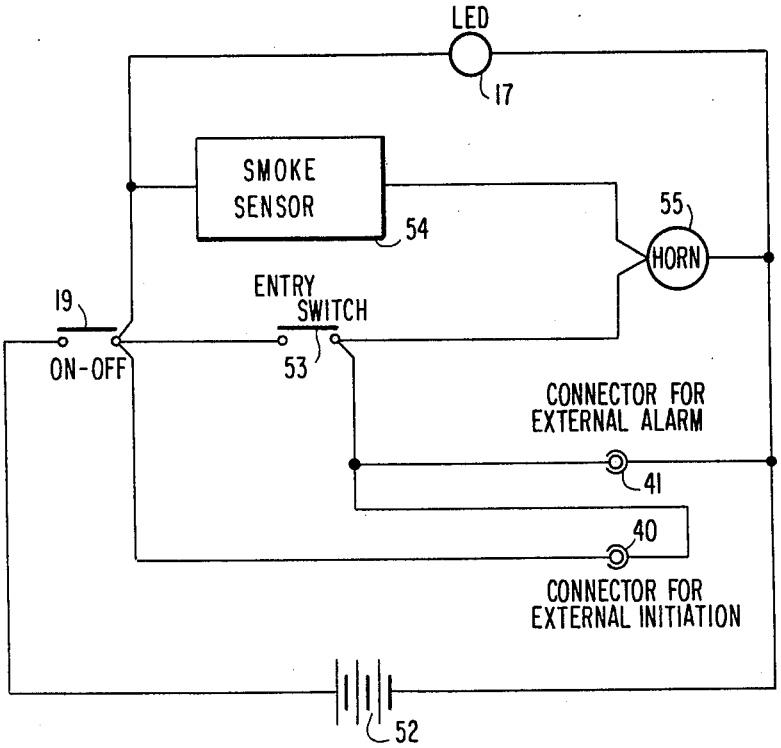

PORTABLE PROTECTIVE DEVICE

RELATED APPLICATION

This application is a continuation-in-part of applicant's prior co-pending application Ser. No. 845,094 filed Oct. 25, 1977, for a portable protective device, now abandoned.

FIELD OF THE INVENTION

The present invention relates to portable devices to sense combustion products or intrusion detection in a portable or permanent installation.

BACKGROUND OF THE INVENTION

Recently, the consuming public has been convinced of the value of fire and burglar alarm protection to the end that a substantial industry now exists in manufacturing products for installation in residential, commercial and industrial environments. Even more recently, research has indicated that the older fire detector which comprised a heat sensor, was of extremely limited utility. More particularly, it has been found that fires can be life threatening without ever significantly raising the ambient air temperature. Smoke or combustion products of the fire can threaten life. The industry has responded to this knowledge by introducing into the market detectors for combustion products, per se. Known detectors operate on optical or ionization principles at relatively low cost.

The need for providing fire and intrusion protection are recognized as evidenced by the commercial success of the industry in selling and installing their products. However, these products have typically been of the type requiring permanent installation, thus, while individuals are travelling, and staying temporarily in a hotel or motel, such protection is not available to them unless the hotel or motel in which they are staying has installed such devices. Significantly, the number of hotels and motels with such protection is relatively small. Furthermore, when individuals are travelling in a camper or trailer, which has the characteristics of a residence, typically it, too, will not be protected.

While the art has recognized the advantage of portable personal protective devices to give, for example, fire protection or to give intrusion protection, there is no suggestion in the prior art of a versatile, portable and adaptable device which can be used to give protection from a variety of dangers which is effective and also usable in a variety of configurations and locations. For example, Demers (U.S. Pat. No. 295,366), Callahan (U.S. Pat. No. 3,266,029) and Fegley (U.S. Pat. No. 3,957,012) all disclose self-contained intrusion protection devices. Similar devices with the added feature of portability are disclosed by Trafford (U.S. Pat. No. 1,112,576), Kardel (U.S. Pat. No. 3,261,010) and Barber (U.S. Pat. No. 3,270,333). Finally, Detweiler (U.S. Pat. No. 2,816,280) discloses a portable fire alarm. While these devices appear to be effective to perform their intended functions, they fail to suggest the extent of versatility, both in terms of function as well as in terms of application which appear to be desirable.

It is therefore one object of the present invention to provide a self-contained personal protective device which can provide the enhanced fire protection associated with a combustion product sensor and will also optionally provide intrusion detection. It is another object of the present invention to provide such a device which is adapted to be employed in temporarily occupied residential type units such as hotels, motels or campers. It is a further object of the invention to provide such a device which is adapted to be mounted in a variety of locations such as on a door, window, curtain rod, or generally supported by any horizontally or vertically oriented lip-type surface. It is a further object of the invention to further increase the adaptability and versatility of the device by providing access for energization by external sensors to provide the capability of energizing external warning devices. For example, in a hotel or motel type situation, an individual might well desire to have combustion product sensing functions for the room he occupies, but would also like to have a heat sensor sensing heat in a common passageway external to the occupied room. Similarly, combustion product sensing in combination with a remote switch type sensor appears desirable. As another example, an optional accessory comprising a visible warning device can be employed which is especially useful for persons with impaired hearing.

SUMMARY OF THE INVENTION

These and other objects of the invention are met by the adaptable self-contained personal protection device of the invention. The device includes a casing including a combustion product sensor in a circuit between a battery power source and an audible warning device. The circuit includes a visible voltage sensor to provide evidence of the energized condition of the device as well as an on-off switch to conserve battery power when not in use.

The circuit has a first switch connected in parallel with the combustion product sensor which comprises a fixed contact, and a movable contact located at the end of a flexible strip. When the casing is installed on an open door, the contacts will be closed under the spring force exerted by the strip. When the door is closed, the door frame will exert a force on the strip causing it to flex and therefore separate the contacts. The casing also includes a mounting device to facilitate mounting, for example, on a door. The mounting arrangement includes a retainer comprising a generally elongated member with at least a portion having an L-shaped cross-section with an arm and lip portions, slidably received in a recess in said casing. Thus, the retainer is adapted to grip any support edge, in either vertical or horizontal orientation. Springs included within the casing bias the retainer against the casing to provide a force for retaining the casing adjacent the support edge. The support edge can include, for example, a door edge, window edge, or curtain rod. The casing also includes provision, such as suitably located holes, for enabling permanent installation of the device.

BRIEF DESRIPTION OF THE DRAWINGS

The present invention will now be described in more detail so as to enable any person skilled in the art to make and use the same, in connection with the attached drawings in which like reference characters identify identical apparatus and in which:

FIG. 1 is a front perspective of the protective device;

FIG. 2 is a rear perspective of the protective device;

FIG. 3 is a side view of the protective device illustrating its mounted condition;

FIG. 4 is a top view, partially broken away, of the protective device in its mounted condition;

FIG. 5 is an electrical circuit diagram of the components mounted in the casing of FIG 1–4;

DETAILED DESCRIPTION

Figure 6A:
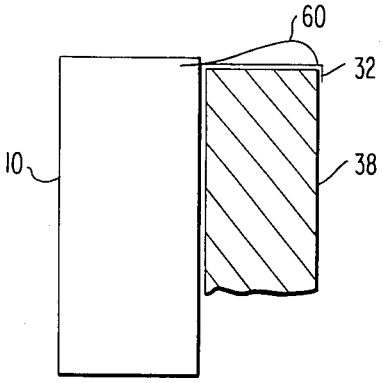
FIGS. 6A and 6B illustrate a preferred embodiment of the protective device in its mounted condition showing the changing condition of the flexible strip.

As shown in FIG. 1, the protective device includes a casing 10 for supporting electrical circuitry illustrated in FIG. 5, and preferably for enclosing the same. Thus, as illustrated in FIGS. 1–3, the casing 10 is provided with a front surface 11, side surfaces 12 and 14, a top surface 13 and a bottom surface (not illustrated). The front surface 11 includes one or more perforations 30; the purpose of this arrangement will become clear hereinafter. Protruding through the front surface 11 is an electrically energized indicator 17, for example, a light-emitting diode, as well as an on-off switch 19 protruding through aperture 18 in the front surface 11.

For mounting, a retainer 31 is illustrated (FIG. 2) which is slidably received in slot 34 in the rear surface 15 of the casing. The retainer 31 is, as illustrated in FIGS. 2 and 3, a generally Z-shaped cross-section, having an arm 33 and a pair of lips 32, 39. The retainer 31 is mounted for back and forth motion in a direction generally perpendicular to the rear surface 15 of the casing. As is illustrated more clearly in FIGS. 3 and 4, a spring 51 bears against the inner surface 56 of the rear wall 15, as well as the lip 39 and thus the spring 51 biases the retainer in a direction so as to reduce the distance between the lip 32 and the rear wall 15 of the casing.

FIG. 4 is a top view of the device mounted on an edge of a support 38. The illustration of the casing is partially broken away to show the spring 51 biasing the retainer 31 toward the wall 15. In a typical example, the support 38 could comprise a door, such as, for example, is illustrated in FIG. 3 which shows the lip 32 engaged adjacent the edge of the door 38. The spring bias of the spring 51 serves to retain the device mounted on the support 38 even if the support 38 undergoes motion. While the support on which the device is mounted can be a door, it will readily be appreciated that it can be mounted in other positions, for example, on a window, curtain rod, etc.

While the Z-shaped cross-section of the retainer 31 is preferable, it will be appreciated that many changes can be made to the particular retainer, for example, it need not be a solid body and may have perforations or indeed may simply comprise an elongate closed form which could generally follow the edge contours of the illustrated retainer 31. On the other hand, the retainer 31 could also have a U-shaped croass-section. The U-shaped retainer is attractive in that it allows the top surface 13 to be closer to the upper edge of the support. Other changes and modifications will be apparent to those skilled in the art.

An operating lever 20 is illustrated in FIG 1–3 as mounted on a side surface 12 adjacent the top of the casing 10 for pivotal motion about a pivot 21. Although not illustrated, the operating lever is preferably spring biased so that the outer extremity of the lever 20 tends to move in a counterclockwise direction, as viewed in FIG. 1; that is, toward the rear surface 15 of the casing. The operating lever 20 has three distinct positions. One of these positions, a reset position, is illustrated by the dotted outline 20′ in FIG. 1. To this end, a lip 22 is formed on, or attached to, the side surface 12 to retain the lever 20 in a recessed position against the operation of the biasing spring. Obviously, the lip 22 can be replaced by other means, such as a detent, for example. A second position of the operating lever 20 is illustrated in FIG. 3. In this position, the lever 20 is maintained against the bias of the spring by the surface 37 which can comprise a wall, for example, above or to the side of a door or window. The operating lever 20 is provided to operate an electrical switch (illustrated in FIG. 5). The electrical switch is maintained in the open condition when the operating lever 20 is in either its recessed or operative positions.

From the foregoing description it should be apparent, assuming that the support 38 comprises a door, that when the door 38 is opened, the operating lever will rotate (clockwise in FIG. 3), under the action of the biasing spring, from its operative position whereby the electrical switch operated by the lever 20 is moved to its closed condition to thus complete an electrical circuit.

Reference is now made to FIG. 5 for an illustration of the apparatus supported within the casing 10. As shown, a battery 52 is coupled in a series circuit with a single pole single throw switch 19, a conventional smoke sensor 54 and an audible warning device or horn 55. An electrically energized indicating device, such as light-emitting diode 17, is coupled in parallel with the series circuit formed by the smoke sensor 54 and horn 55. A single pole single throw electrical switch 53 is coupled in parallel to the smoke sensor 54. The electrical switch 53 is the switch operated by the lever 20 such that when the lever 20 moves from its operative or reset position to its operated position, the switch 53 is closed, completing an electrical circuit through the battery to the audible warning device 55.

Smoke sensor 54 represents a conventional optical or ionic smoke detector, or equivalent. In the presence of combustion products, exceeding the smoke sensor's threshold, the smoke sensor 54 acts as a closed switch, thus also completing an electrical circuit between the battery 52 and the audible warning device 55. In order for the smoke sensor 54 to sense combustion products, the perforations 30 (see FIG. 1) are provided in at least one surface of the casing 10. Furthermore, in order to effectively couple the audible warning signal from the horn 55 to a user, the same or additional perforations are illustrated in casing 10. Although two series of perforations 30 are illustrated in FIG. 1, such showing is merely exemplary. At least one perforation is required, and as many other perforations may be provided as appear desirable.

In order to increase the versatility of the device, an optical warning device is also provided as an optional attachment, which is particularly useful for persons of impaired hearing. As shown in FIG. 3, the optical warning device 47 includes a locating plug 49 which is adapted to fit in a locating recess 42 in a side wall and connected in parallel with the audible waring device 55. The optical warning device 47 includes an electrical plug 48 for making electrical connection to the jack 41. Finally, an illuminating means such as lamp 50 is provided in the warning device 47. With the optical warning device 47 electrically coupled to the connector 41.

whenever the horn 55 is energized, the light 50 will also be illuminated.

As thus far explained, the device is capable of detecting combustion products and energizing an audible or optical alarm responsively. The protective device is also capable of acting as a burglar or intrusion detection device and likewise energizing the audible and optical warning devices responsive to intrusion detection. Under certain circumstances, it may be desirable to provide an external actuator to energize either one or both of the warning devices. Such an external actuator could, for example, comprise a heat sensor, a further intrusion detector, or any equivalent switch-closing detector. To this end, a typical external initiating device 45 is illustrated in FIG. 3, as being coupled through a conductor 44 and a plug 43 to a jack 40. As illustrated in FIG. 5, the electrical connection 40 is coupled in parallel with the switch 53 such that, for example, when the external detector 45 closes, a circuit will be provided for energizing the audible warning device 55 and the optical device 47, if connected in the circuit. As shown in FIG. 3, the detector 46 could comprise a heat sensor or other remote sensor placed as desired adjacent other doors or windows.

Although one of the specific advantages of the protective device is its portability, it may be desirable, under certain cirscumstances, to provide for permanent or semi-permanent mounting. To this end, the rear surface 15 includes a pair of mounting holes 36 or the equivalent arranged to support the protective device on protruding supports such as screw heads, nail heads, or the like. Preferably, the rear surface 15, which may come into close contact with the support is provided with one or more pads 35 so as to insure that the protective device does nor mar or scratch the finish of a door or window on which it is mounted.

The casing itself can comprise any suitable material, molded or formed in accordance with conventional techniques. As will be apparent to those skilled in the art, one or more surfaces, or a portion thereof, is removable for access to the circuitry in order to replace worn batteries, or for repair purposes.

DETAILED DESCRIPTION OF A PREFERRED EMBODIMENT

Figure 6B:
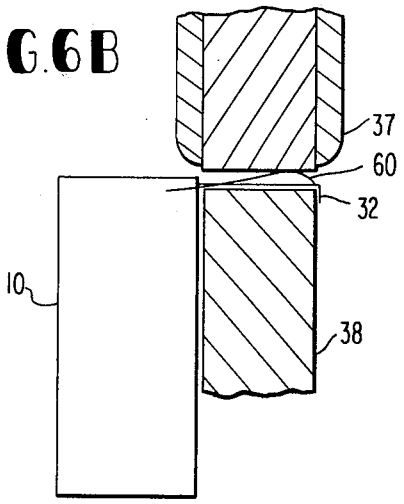

Another, and preferred, embodiment of the invention, provides for the elimination of the operating lever 20, its pivot 21 and the spring biasing therefor as well as the lip 22 formed on the side of the casing (see FIG. 1). In its stead, a flexible strip 60 is provided, having a contact supporting end for a contact 61. The entry switch 53, in the preferred embodiment, comprises the contact 61 and its corresponding contact 62. The particular form of the strip 60 and its mounting in relation to the other elements of the protective device are illustrated in more detail in FIGS. 6A, 6B, 7A, 7B, 8A and 8B. In all other respects the protective device may be as shown in FIGS. 1–5. Referring now to FIG. 6A, there is shown a side view of the protective device 10 mounted on an open door 38 and retained in that position by the retainer 32. Under these circumstances, flexture of strip 60 causes contacts 61 and 62 of the entry switch (not shown) to be closed. FIGS. 6B illustrates the protective device 10 mounted on a door 38 which is closed, as indicated by the adjacent frame 37. Under these circumstances, the spring 60 is flexed by the frame, and as a result, its supported contact 61 is brought out of engagement with the corresponding contact 62 so as to maintain the switch 53 in an open condition. It should be apparent that once mounted as shown in FIG. 6B, if the door 38 is opened, the strip 60 flexes, bringing its contact 61 into mating relation with the corresponding contact 62 to thereby close the switch and provide for energization of the alarm.

Figure 7A:
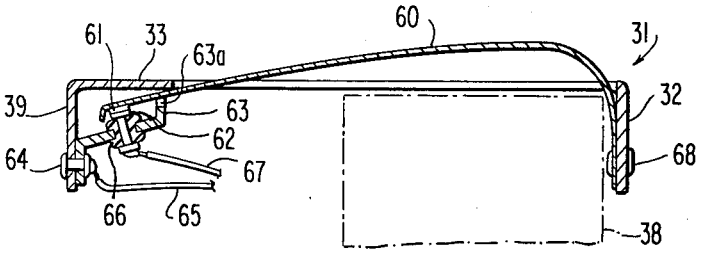
FIGS. 7A is a detail of the retainer and strip showing its relationship to a door.
Figure 7B:
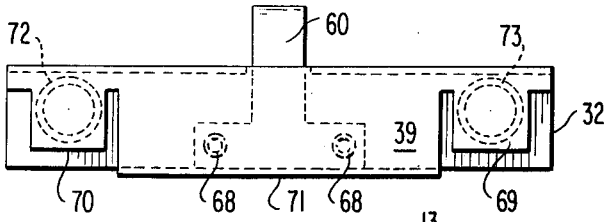
FIG. 7B is a rear end view of the retainer.

FIGS. 7A and 7B show in more detail the relationship between retainer 31, strip 60 and the relevant contacts; FIG. 7A comprising a section of the retainer 31 through its center. As shown there, the retainer 31 comprises an arm portion 33 which is slidably received in the casing and a lip portion 32. The door 38 is shown in dotted outline. To provide for the strip 60, the arm portion 33 has a slot longitudinally cut therein in a direction parallel to the path of travel of the retainer. The flexible strip 60 protrudes therethrough and it is fastened at one end, to the lip 32 by the fastening means 68 such as rivets. The flexible strip 60 is bent so it has a gently curving somewhat L-shaped cross-section and carries at its end opposite the riveted end, an elecrical contact 61. Mounted on the other lip 39 of the retainer 31 is a bracket 63. As shown in FIG. 7A, the bracket 63 is mounted on the lip 39 via rivet 64 which has an electrical conductor 65 connected thereto. A hole is cut into the bracket 63 opposite the contact 61 and an insulator 66 is mounted therethrough. Mounted within the insulator is contact 62 which has electrically connected thereto an electrical conductor 67. The bracket 63 includes an edge **63*a* on which the strip 60 pivots when compressed by a door frame, such as the door frame 37. Accordingly, in the uncompressed state, strip 60 assumes a shape such that the contacts 61 and 62 are in electrically mating engagement and thus comprise a closed entry switch 53. However, when flexible strip 60 is compressed by the door frame, this strip 60 pivots on the edge 63*a* removing the contact 61 from engagement with contact 62 and thereby opening the circuit. Flexible strip 60** can be formed of any material exhibiting the required spring-like characteristics; metal is at least one such suitable material.

FIG. 7B is an end view of the retainer; as shown there, the strip 60 has a T-shape adjacent the lip 32 where it is fastened by the pair of rivets 68. The lip 39 can be described as comprising three integral portions, a continuous center portion 71, and two end portions 69 and 70, separated from the center portion 71 by a slot cut partially through the lip 39. The dotted circles shown in FIG. 7B represent an end view of a pair of springs 72 and 73 employed for biasing the retainer against the casing. It is evident by a comparison with FIG. 6A that, when retainer 31 is allowed to slide into the casing, strip 60 will be flexed by contact with the casing, causing contacts 61 and 62 to separate.

Figure 8A:
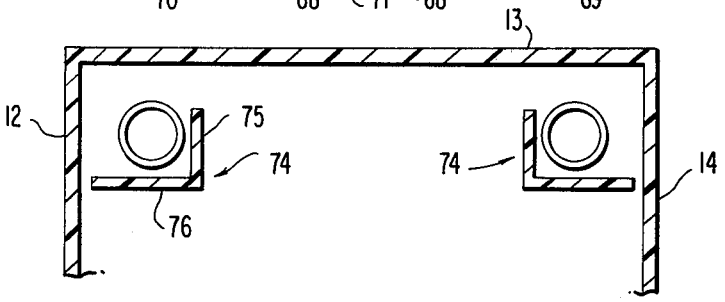
FIGS. 8A and 8B are side and end sections of the casing more particularly illustrating the mounting of the springs.

FIG. 8A is a section of the casing illustrating the interior surface of the wall of the casing adjacent the door 38. As shown, a pair of guides 74 are mounted between the front side 11 of the casing and the rear side, adjacent the door. The guides 74 are formed of two perpendicularly oriented elements, a horizontally oriented element 76 and a vertically oriented element 75. The two vertically oriented guide elements 75 are located so as to support the retainer 31 by having the retainer 31 ride on the guides 75 fitting within the slots between the end portions 69 and 70 of the lip 39. The horizontally oriented portions 76 are arranged to support the springs 72 and 73 which provide the biasing for the retainer 31. The guides 74 may be molded at the same time as the casing itself is molded. In the alternative, they can comprise elements separate from the casing and affixed thereto by conventional means. The guides 74 can be formed of any suitable material.

Figure 8B:
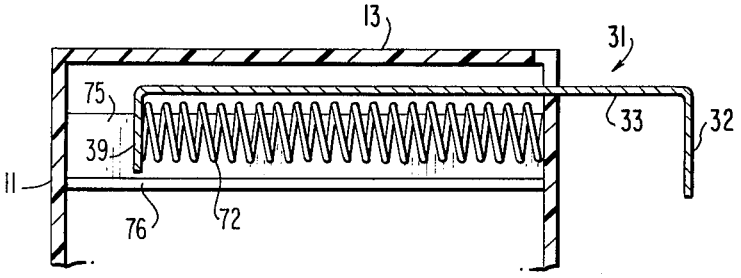

FIG. 8B is a side section showing the retainer 31, mounted in the casing adjacent the top side 13 and the front side 11. As illustrated, the typical spring 72 biases the retainer by engaging the lip 39. The guide portions 75 and 76 are also illustrated in FIG. 8B.

In all other respects, the preferred embodiment may be identical to the embodiment first discussed with regard to FIGS. 1–5.

What is claimed is:

1. An adaptable, self-contained protection device for providing a warning upon detection of combustion products, and optionally a warning of intrusion, which can be installed on a temporary basis in a variety of locations, and removed without leaving evidence of its installation, or can be permanently installed, said device comprising:

a casing with plural surfaces, a circuit installed within said casing including a battery, and connected thereto a series circuit including a combustion products sensor, an electrically operated audible warning device and at least a further switch connected across said combustion products sensor, and on ON-OFF switch in series with said combustion products sensor, said further switch having a spring-biased operating lever mounted on said casing, said lever having at least operative, operated, and reset positions, with said spring biasing said lever to said operated position, said further switch operated to a closed position when said operating lever is in its operated position, and a lever retaining means mounted on said casing to maintain said lever in said reset position when said lever is engaged with said retaining means against said spring-bias, said further switch having an open condition when said operating lever is in either said operative or reset positions, a power ON indicator with visible output connected in parallel across said combustion product sensor and said electrically operated audible warning device, mounting means for said casing adjacent one of said surfaces including a retaining means having an arm and a generally perpendicular lip portion adapted to mount said device to a support by engaging said lip portion over an edge of said support, said mounting means including a recess in said casing in which said arm portion is slidably received, and spring biasing means biasing said retaining means lip portion toward a surface of said casing, said casing surfaces including a plurality of openings communicating with said combustion products sensor and said audible warning device by providing an air draft to said combustion product sensor and for conducting audible warning signals produced by said audible warning device through said casing surface, said casing surface including an additional opening through which at least a portion of said ON-OFF switch extends, and another opening through which a visible signal from said indicator is viewable.

2. The apparatus of claim 1 wherein said retaining means comprises a thin and sheet-like retainer with a generally Z-shaped cross-section, with said arm portion connecting said lip portion with a second lip portion parallel to said lip portion and extending from said arm portion in a direction opposite a direction said lip portion extends away from said arm portion, said spring biasing means bearing against said second lip portion.

3. The apparatus of claim 1 wherein said retaining means comprises a thin and sheet-like retainer with U-shaped cross-section, with said arm portion connecting said lip portion with a second lip portion parallel to said lip portion and extending from said arm portion in a direction the same as the direction said lip portion extends from said arm portion, said sring biasing means bearing against said second portion.

4. The apparatus of claim 1 in which said circuit further includes a connector coupled in parallel to said audible warning device and in which said casing includes a hole mounting said connector, an optical warning device including an electrically energized light-emitting means electrically connected to a plug mounted in said connector.

5. The apparatus of claim 1 in which said circuit includes an electrical connector coupled in parallel to said further switch and opening in said casing in which said connector is mounted, and an external event resonsive means electrically connected to said connector.

6. The apparatus of claim 5 in which said external event sensor comprises a heat sensor.

7. An adaptable, self-contained personal protection device for providing a warning on detection of combustion products, and optionally a warning of intrusion, which can be installed on a temporary basis in a variety of locations, and removed without leaving evidence of its installation, or can be permanently installed, said device comprising:

a casing with plural surfaces, a circuit installed within said casing including a battery, and connected thereto a series circuit including an on-off switch, combustion products sensor and electrically operated audible warning device, an electrically energized indicator with visible output connected in parallel across said combustion products sensor and said electrically operated audible warning device, and at least a further switch connected across said combustion products sensor, said further switch comprising a flexible strip and a contact mounted at a free end thereof, a mating contact, said contact and mating contacts connected across said combustion products sensor, mounting means for said casing adjacent one of said surfaces including a retainer having an arm and a generally perpendicular lip portion adapted to mount said device to a support by engaging said lip portion over an edge of said support, a recess in said casing in which said arm portion is slidably received, spring biasing means biasing said retainer lip portion toward a surface of said casing, said flexible strip mounted to said lip, a pivot fixedly mounted with respect to said contact and adjacent said mating contact, said strip fashioned to bring said contacts into electrical engagement in an unrestrained condition and when compressed to disengage said contacts by pivoting movement about said pivot, said recess, said retainer and said flexible strip arranged to produce compression of said strip and opening of said contacts when said retainer is withdrawn into said recess, said casing surfaces including a plurality of openings, one through at least which a portion of said on-off switch extends, a second communicating with said combustion products sensor and said audible warning device by providing an air draft to said combustion products sensor and for conducting audible warning signals produced by said audible warning device through said casing surfaces, and a third opening through which a visible signal from said indicator is viewable.

8. The apparatus of claim 7 wherein said retainer is thin and sheet-like with U-shaped cross-section.

9. The apparatus of claim 7 in which said circuit further includes a connector coupled in parallel to said audible warning device and in which said casing includes a hole mounting said connector, an optical warning device including an electrically energized light-emitting means electrically connected to a plug mounted in said connector.

10. The apparatus of claim 7 in which said circuit includes an electrical connector coupled in parallel to said further switch and opening in said casing in which said connector is mounted, and an external event responsive means electrically connected to said connector.

11. The apparatus of claim 10 in which said external event sensor comprises a heat sensor.

12. The apparatus of claim 7 wherein said mounting means is adjacent a top surface of said casing.

13. The apparatus of claim 7 in which said retainer has a U-shaped cross-section, a first lip to which said strip is mounted, a second lip supporting said pivot and said mating contact, and, said arm of said retainer having a slot extending parallel to the direction of motion of said retainer through which said strip extends.

14. The apparatus of claim 13 in which said second lip includes three portions, a center portion separated by a slots from two end portions and said casing includes, guides fixed to said casing extending into said slots for supporting and guiding said retainer.

15. The apparatus of claim 14 in which said spring means includes a pair of springs, each supported adjacent a one of said guides.

* * * * *